US011417985B2

(12) United States Patent
Schreier et al.

(10) Patent No.: US 11,417,985 B2
(45) Date of Patent: Aug. 16, 2022

(54) PLUG CONNECTOR

(71) Applicant: HARTING ELECTRIC GMBH & CO. KG, Espelkamp (DE)

(72) Inventors: Stephan Schreier, Rahden (DE); Gert Havermann, Wallenhorst (DE); Thomas Heimann, Rahden (DE); Manuel Kleinheider, Bad Oeynhausen (DE)

(73) Assignee: HARTING ELECTRIC GMBH & CO. KG

( * ) Notice: Subject to any disclaimer, the term of this patent is extended or adjusted under 35 U.S.C. 154(b) by 0 days.

(21) Appl. No.: 17/267,762

(22) PCT Filed: Oct. 8, 2019

(86) PCT No.: PCT/DE2019/100870
§ 371 (c)(1),
(2) Date: Feb. 10, 2021

(87) PCT Pub. No.: WO2020/074044
PCT Pub. Date: Apr. 16, 2020

(65) Prior Publication Data

US 2021/0226379 A1 Jul. 22, 2021

(30) Foreign Application Priority Data

Oct. 11, 2018 (DE) ..... 10 2018 125 121.1

(51) Int. Cl.
*H01R 13/52* (2006.01)
*H01R 13/717* (2006.01)

(52) U.S. Cl.
CPC ..... *H01R 13/5202* (2013.01); *H01R 13/7172* (2013.01); *H01R 13/7175* (2013.01)

(58) Field of Classification Search
CPC ..... H01R 13/5202; H01R 13/7172; H01R 13/7175
(Continued)

(56) References Cited

U.S. PATENT DOCUMENTS 5,327,328 A * 7/1994 Simms ..... G02B 6/0001 362/555
5,810,620 A * 9/1998 Kobayashi ..... A61B 1/00128 439/607.17
(Continued)

FOREIGN PATENT DOCUMENTS

CN 101485004 7/2009 ..... H01L 33/00
CN 104115342 10/2014 ..... H01R 13/52
(Continued)

OTHER PUBLICATIONS

International Search Report (w/ English translation) and Written Opinion, issued in PCT/DE/2019/100870, dated Dec. 19, 2019, 13 pages.
(Continued)

*Primary Examiner* — Abdullah A Riyami
*Assistant Examiner* — Vladimir Imas
(74) *Attorney, Agent, or Firm* — Hayes Soloway P.C.

(57) ABSTRACT

Disclosed is a plug connector having a plurality of electrical contact elements and an elastic sealing body. The elastic sealing body has a transparent sealing ring which is connected to at least one light guide arm which extends away from the sealing ring.

20 Claims, 3 Drawing Sheets

(58) Field of Classification Search
USPC ..... 439/271
See application file for complete search history.

(56) References Cited

U.S. PATENT DOCUMENTS

| | | | | |
|---|---|---|---|---|
| 6,507,292 | B1 * | 1/2003 | Feichtinger | G01D 5/34738 439/493 |
| 6,644,989 | B2 * | 11/2003 | Robinson | H01R 13/44 439/490 |
| 6,942,520 | B2 * | 9/2005 | Barlian | H01R 13/6277 439/352 |
| 7,329,034 | B2 * | 2/2008 | Verdes | G02B 6/0006 362/555 |
| 7,891,855 | B2 * | 2/2011 | Yang | G02B 6/0001 362/624 |
| 7,914,315 | B2 * | 3/2011 | Kuhn | A61C 3/04 439/345 |
| 8,884,773 | B2 * | 11/2014 | Wiesemann | B60R 16/00 320/109 |
| 9,059,580 | B2 * | 6/2015 | Magno, Jr. | H02G 15/013 |
| 9,064,827 | B2 * | 6/2015 | Fujii | H01L 27/3246 |
| 9,389,104 | B2 * | 7/2016 | Mouard | G01D 13/00 |
| 9,431,755 | B2 | 8/2016 | Lux et al. | H01R 13/505 |
| 9,461,397 | B2 | 10/2016 | Feldmeier | H01R 13/5219 |
| 9,562,663 | B2 | 2/2017 | Gebauer et al. | F21S 48/1329 |
| 9,586,461 | B2 * | 3/2017 | Okuda | B32B 17/10036 |
| 9,863,594 | B2 * | 1/2018 | Landcastle | F21S 41/162 |
| 9,997,375 | B2 * | 6/2018 | Serita | H01L 33/005 |
| 10,139,543 | B2 * | 11/2018 | Carullo | G02B 6/0006 |
| 2004/0005820 | A1 | 1/2004 | Gutierrez et al. | H01R 24/00 |
| 2007/0264880 | A1 * | 11/2007 | Schiffer | H01R 13/5202 439/752 |
| 2011/0230065 | A1 * | 9/2011 | Bergner | G02B 6/426 439/55 |
| 2014/0120764 | A1 * | 5/2014 | Valadas | H01R 13/703 439/488 |
| 2015/0031235 | A1 * | 1/2015 | Wiesemann | B60R 16/00 29/593 |
| 2016/0226199 | A1 * | 8/2016 | Zhou | H01R 13/7175 |
| 2016/0322761 | A1 * | 11/2016 | Wu | H01R 13/7175 |
| 2016/0372857 | A1 * | 12/2016 | Wu | H01R 13/5825 |
| 2017/0133804 | A1 | 5/2017 | Macauda | H01R 25/003 |

FOREIGN PATENT DOCUMENTS

| | | | |
|---|---|---|---|
| CN | 104154474 | 11/2017 | F21S 8/10 |
| DE | 296 19 496 | 3/1998 | H01R 13/717 |
| DE | 10 2005 025 670 | 12/2006 | G01D 21/00 |
| DE | 10 2007 018 177 | 8/2008 | H01R 13/717 |
| DE | 10 2012 202 225 | 10/2015 | F16J 15/10 |
| DE | 20 2016 104 369 | 11/2016 | H01R 13/66 |
| DE | 20 2017 100 608 | 3/2017 | G02B 6/43 |
| DE | 10 2016 104 081 | 9/2017 | H01R 13/717 |
| DE | 20 2016 008 383 | 11/2017 | H01R 13/66 |
| EP | 1 156 554 | 11/2001 | H01R 13/52 |
| EP | 1 315 248 | 11/2001 | H01R 13/629 |
| EP | 1 351 340 | 1/2003 | H01R 13/447 |
| GB | 1 571 792 | 7/1980 | H02G 3/22 |
| WO | WO 2008003176 | 1/2008 | H01L 33/00 |

OTHER PUBLICATIONS

German Search Report issued in German Patent Appln. Serial No. 10 2018 125 121.1, dated Sep. 26, 2019, with machine English translation, 15 pages.

International Preliminary Report on Patentability issued in PCT/DE/2019/100870, dated Apr. 8, 2021, 7 pages.

Chinese Official Action issued in related Chinese Patent Application Serial No. 201980066768.x, dated Apr. 26, 2022, 7 pages, with English Search.

* cited by examiner

PLUG CONNECTOR

BACKGROUND OF THE INVENTION

The invention relates to a plug connectors.

In general, a plug connector comprises a plurality of electrical contact elements, and is used as a connecting piece at cables, or directly at housings, as a built-in plug or socket. Protection classes with regard to sealing against dust, water spray or immersion must be observed here.

In addition to electrical contact elements, a generic plug connector also comprises an elastic sealing body in order to provide adequate sealing to a housing wall on which the plug connector is to be mounted.

In general it is desirable to provide an illuminated indicator that shows the state of an electrical interface for which the plug connector is used.

In the case of devices with a low protection class such as IP20, status indicators are frequently integrated directly into the plug connectors. In the case of RJ45 plugs such as are used for network cables, illuminated signals can show the status of a network connection, for example in relation to a connection structure or to a data transfer through the plug connector. Devices with a higher protection class, such as IP67, on the other hand, use separate LEDs for status indicators that are arranged in respective openings at the housing, independently of the plug connector. The openings can have their own seal, but can also, for example, be glued transparently or provided with a screw-in lens. This means that a significantly greater effort must usually be accepted to provide a status indicator for higher protection classes.

PRIOR ART

DE 10 2012 202 225 B4 shows a plug connector with contact elements and elastic seals at a cable-end and at a plug-end of the plug connector. A plug connector with a seal between two housing parts is known from both DE 20 2016 104 369 U1 and from DE 20 2016 008 383 U1. A status indicator is not described in these documents. DE 20 2017 100 608 U1 describes a plug connector with a status indicator. LEDs with corresponding electronics are accommodated for this purpose in the housing of the plug connector.

OBJECT OF THE INVENTION

One object of the invention is that of providing a plug connector that offers an illuminated indication with the best possible sealing and a simple construction. A corresponding sealing body is also to be given.

SUMMARY OF THE INVENTION

According to the invention, in the plug connector of the above-mentioned type the elastic sealing body comprises a transparent sealing ring that is connected to at least one light guide arm that extends away from the sealing ring.

Since a sealing ring of transparent material is used, the sealing ring can not only be used for sealing, but at the same time also for the output of light. The transparency should be present here in the visible wavelength range, or at least a partial range thereof. The at least one light guide arm makes it possible for light from a light source to be guided to the sealing ring. The light source can in particular be arranged in a housing at which the plug connector is to be attached. As a result, apart from the plug connector, no additional components are required in order to guide light from a light source onwards and to radiate it out.

A single housing opening is thus enough for the plug connector, and no additional opening is necessary for a light indication.

The light guide arm can extend away from the sealing ring in an axial direction. The light guide arm thus passes from the sealing ring into the housing, meaning away from the plug end at which the electrical contact elements are located. The axial direction identifies the longitudinal direction of the plug connector; the sealing ring runs in an annular manner around this axis. Apart from an axial direction component, the longitudinal axis of the light guide arm can also comprise another direction component. The light guide arm can, for example, be spiral or have a spiral section. The light guide arm can alternatively also extend inwards from the sealing ring in a radial direction. A light guide arm can, in addition, also comprise one or a plurality of kinks or bends. It is furthermore possible that two or more light guide arms have different shapes.

In one form of embodiment of the invention, the sealing ring and the at least one light guide arm are formed as one piece, through injection molding for example, wherein both consist of the same transparent and elastic material. A one-piece design can be advantageous so that even under pressure an unbroken connection between the light guide arm and the sealing ring is ensured if the seal is pressed against a housing wall.

The plug connector can comprise a nut to press the sealing ring against a housing wall. This can be screwed onto an external thread of an enclosing wall of the plug connector, and be adjustable relative to the sealing ring, in order to develop a pressure between the sealing ring and the housing wall.

Even if the sealing ring and the at least one light guide arm are not formed as one piece, they can consist of the same material. Light losses resulting from reflections that occur at boundary surfaces between materials with different refractive indices can hereby be avoided or at least reduced. The at least one light guide arm can, however, also be connected to the sealing ring via a respective sprue gate.

The terms outer jacket face, inner face, end face and sealing face will be used in the present description to identify the various faces of the sealing ring. The outer jacket face here identifies the surrounding surface that runs around the longitudinal axis of the plug connector. Opposite the outer jacket face, i.e. facing inward, the inner face bounds the sealing ring. The end face of the sealing ring faces toward a plug end/connecting end of the plug connector. The end face can be planar, or can also have another shape, for example corrugated or rounded. Opposite the end face, the sealing ring comprises the sealing face, which is preferably planar to provide a seal against, in particular, a housing wall.

It can be preferable if the at least one light guide arm is connected to the sealing ring at the inner face of the sealing ring. Light is thus guided into the sealing ring from the light guide arm at the inner face. Deformations resulting from the sealing pressure are relatively low at the inner face, which can be advantageous for the desired light guidance.

Each light guide arm can comprise a deflection face at which light travelling inside the light guide arm is reflected in the direction of the sealing ring. The deflection lace can be located in the axial direction at the level of the sealing ring, and can be oriented at an angle of 45°, or, more generally, of between 35° and 55°, to the axial direction.

Seen in the radial direction, a light guide arm and its deflection face can thus be arranged in a central region inside the sealing ring.

The deflection face can be oriented at an angle to the light guide arm, so that light is reflected to the deflection face through total internal reflection. As a result, no further components are required for light guidance and deflection. The angle at which total internal reflection is possible depends on the refractive index of the material of the light guide arm and on the wavelength of the light, wherein, in the present case, light from the visible spectral band is to be assumed. An angle of incidence relative to a normal to the surface must be sufficiently large for total internal reflection; to enable this, each light guide arm can have two deflection faces following one another. Light is thus reflected twice in sequence, and thereby deflected by a total of about 45°.

Deflection can also be achieved by mirroring the deflection face instead of by total internal reflection. A reflective layer of, for example, silver can be vaporized here on to the surface.

An outer jacket face and/or an end face of the ring can be roughened to radiate light diffusely. On the other hand, an inner face of the ring, and the surface of the at least one light guide arm, can be smooth in order to avoid light being coupled out at these surfaces. The terms "rough" and "smooth" can be understood to mean that the roughened faces have greater roughness than the smooth faces. The surface of the light guide arm should comprise its light inlet face as well as its side faces, which can be oriented essentially perpendicularly with respect to its light inlet face.

The term "light guide arm" can be understood to mean an elongated shape whose primary extension component can extend in the axial direction of the plug connector. One end of the light guide arm that points away from the sealing ring can represent the light inlet face.

To achieve in particular a more uniform light distribution in the sealing ring, a cross-section of the at least one light guide arm can become greater towards the sealing ring. Alternatively or in addition, the light deflection face can be convex for the same purpose, so that reflected light is fanned out.

So that the light propagation in the sealing ring is as uniform as possible, the sealing ring can also be widened in the radial direction at each connecting region to a light guide arm.

For a more uniform light propagation, scattering centers can also be formed inside the sealing ring, for example gas bubbles or interfering enclosures.

The sealing ring can protrude radially outward further than the other components of the plug connector that lie, in the installed state, outside the housing. The end face of the sealing ring is thus not completely covered. As a result, outward light radiation at the end face is at least not completely blocked by other components of the plug connector. In other words, a radius of the sealing ring can be greater than a radius of the other components of the plug connector that are located between the sealing ring and a plug end of the plug connector. If a fastening component, in particular a screw, a nut or a washer, and a corresponding opposing piece, are used at the end face of the sealing ring in order to press the sealing ring against the housing wall, the sealing ring accordingly has a greater diameter. A pressing region of the sealing ring is consequentially smaller than the surface of the end face (or smaller than the area of the sealing face) of the sealing ring.

Multiple light guide arms can also be connected to the sealing ring. These can extend parallel to one another. Light from a respective light source can be guided via each light guide arm. The light guide arms can be distributed uniformly in the circumferential direction, for example two light guide arms located opposite one another, or three light guide arms each arranged 120° apart. If light sources that radiate in the same spectral region are used, then a more uniformly distributed light radiation can be achieved around the circumference of the sealing ring. In the case of light sources that radiate in different spectral regions, the sealing ring can radiate light of different colors via the different light guide arms. Different statuses can, for example, be indicated in this way.

The invention also comprises an electronic device with a housing that has at least one opening it which a plug connector according to the invention is arranged. The sealing ring establishes a seal of the plug connector against the housing wall in which the opening is formed. The opening is thus, for example, sealed against fluids according to IP67. At least one light source is present in the housing, and is arranged such that light radiated from the light source is coupled via a light inlet face into the at least one light guide arm of the plug connector. Light can thus be guided via the light guide arm that extends through the opening out of the housing, where it is emitted by the sealing ring that lies against an outer face of the housing, for a light indication of the electronic device.

The at least one light source can be located on a circuit board in the housing. The light inlet face of the at least one light guide arm can be arranged next to the at least one light source. The elastic material of the light guide arm can, in principle, be pressed in direct contact against the light source. In order to avoid self-reflections, a clearance between the light inlet face and the associated light source can, however, also be provided. The light inlet face can, moreover, be concave, i.e. curving to the inside, so that light impinging upon it is coupled in as completely as possible.

Multiple light sources that differ in the spectral bands that they transmit can be arranged on the circuit board. As described earlier, the light of the multiple light sources can be guided via multiple light guide arms. Alternatively, it can also be possible for the light of the multiple light sources to be guided to the sealing ring by way of the same light guide arm. A surface of the light inlet face can, for this purpose, be sufficiently large that it is adjacent to multiple light sources on the circuit board.

The plug connector can have a cylindrical segment that is inside the housing when in the installed state. The cylindrical segment can, for example, consist of metal, and for each light guide arm can have an axial groove to accommodate the respective light guide arm. A grip of the sealing body on other components of the plug connector can hereby be improved.

The electronic device can comprise an electronic control unit that is configured always to switch the at least one light source on when a data transfer takes place via the associated plug connector. A status indicator can be formed in this way without separate housing openings being necessary for this purpose. In the case of multiple light sources, whose light can be guided by way of the light guide arms, the electronic control unit can be configured to indicate various states by activating the different light sources.

The plug connector of the invention can also, for example, be integrated into a switch as an interface with display. The invention can be employed flexibly for various applications, for example also as a wall feed-through. The physical size and geometry can, in principle, be arbitrary here. When embodied as a round plug, the sealing ring can have a circular, annular cross-section. With other plug forms, however, the sealing ring can also have a different cross-section, for example a rounded, annular rectangular form. The plug connector can be designed as a male plug or built-in plug, or as a female coupling or socket. The electrical contact elements can accordingly be contact pins or contact openings.

The present invention also relates to a sealing body. This comprises an elastic, transparent sealing ring that is connected to at least one light guide arm that extends away from the sealing ring. Advantageous embodiments of the sealing body correspond to the variants that are described in relation to the sealing body of the plug connector. The sealing body according to the invention can be employed for the plug connector described here, also for other electrical or electronic components that are to be attached in a sealed manner to a housing opening. These can, for example, be switches, buttons, input devices, cable outlets, sensors, displays or transmitters.

BRIEF DESCRIPTION OF THE DRAWINGS

Exemplary embodiments of the invention are illustrated in the drawings and are explained in more detail below. In the drawings.

The figures partially contain simplified, schematic illustrations. The same elements are usually identified by consistent reference signs.

DETAILED DESCRIPTION OF THE INVENTION

Figure 1:
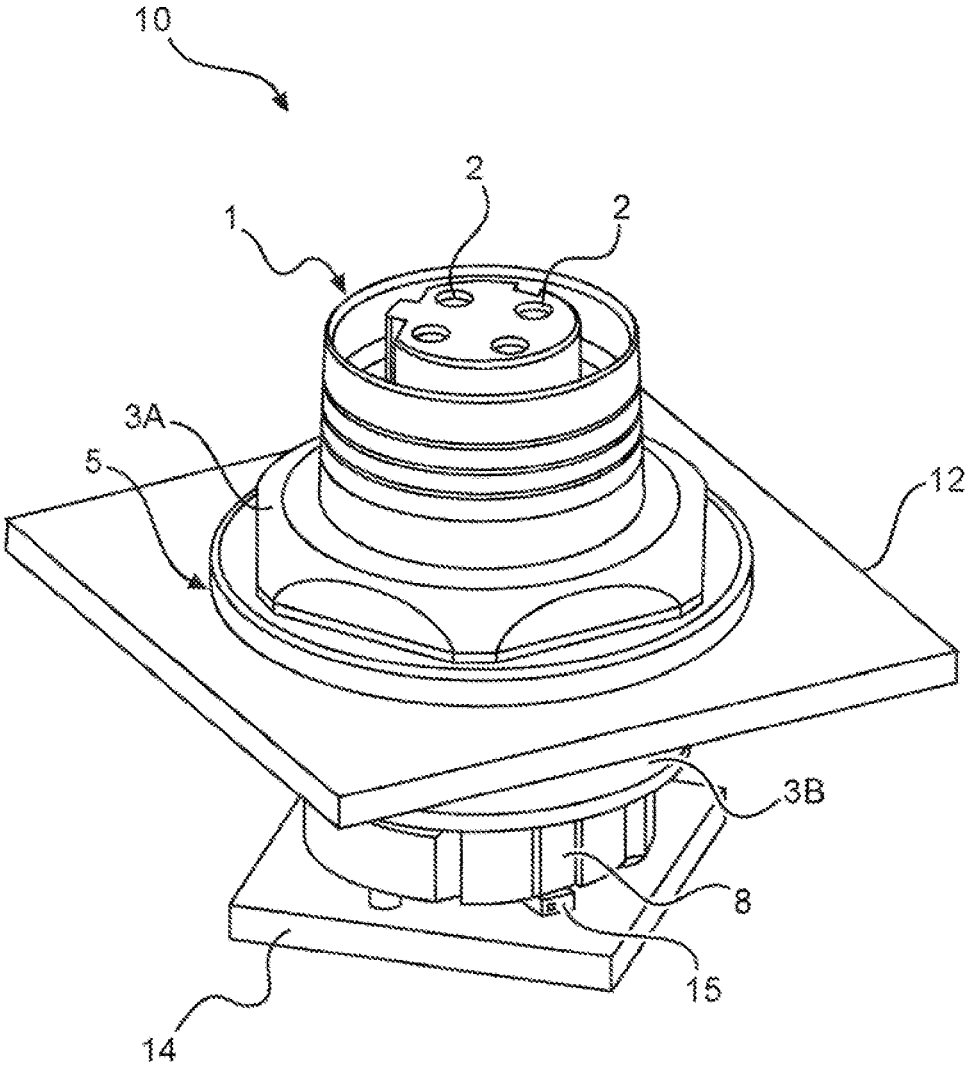
FIG. 1 shows a perspective view of a plug connector in an installed state.

The exemplary embodiment of a plug connector 1 according to the invention is described with reference to FIGS. 1 to 3. FIG. 1 shows the plug connector 1 in an installed state in an opening of a housing wall 12 of an electronic device 10. FIG. 3, on the other hand, shows the plug connector 1 in a non-installed state, wherein a housing flange of the plug connector 1 is visible, while electrical contacts of the plug connector 1 are hidden.

As shown in FIG. 1, the plug connector 1 comprises a plurality of electrical contacts 2 at its plug end and, in the example illustrated, is constructed as a round plug connector, although other forms are also possible.

The plug connector 1 comprises a sealing body 4 in order to establish a desired sealing of the plug connector 1 against the housing wall 12. The sealing body 4 is shown more precisely in FIG. 2, and comprises a sealing ring 5 and at least one light guide arm 8; a plurality of light guide arms 8 are present in the illustrated example. The sealing body 4 comprises or consists of an elastic material, for example of a thermoplastic elastomer. The sealing ring 5 can thereby be pressed in a sealing manner against the housing wall. A seal that accords with a higher protection class can be achieved hereby. At the same time, a visual signal indication is enabled in a simple manner, without the sealing properties being impaired or complex additional measures being necessary. This is achieved in that the sealing body 4 consists of a transparent material and has light guide arms 8 that guide light from a light source in the housing to the sealing ring 5. Light can thus be radiated out by way of the sealing ring 5. Advantageously, no additional housing windows or holes are necessary for this purpose. Rather, with reference to FIG. 1, a single hole or opening in the housing wall 12 is enough for the plug connector 1, in order to provide both an electrical connection via the contact elements 2 as well as a visual display by means of an illumination of the sealing body 4.

As shown in FIG. 1, the electronic device 10 can comprise at least one light source 15, for example a laser or an LED that is arranged on a circuit board 14 in the housing 12. Each light guide arm 8 of the sealing body 4 extends into the housing in an axial direction, and ends next to one of the light sources 15. A face of the light guide arm 8 adjacent to the light source 15 is referred to here as the light inlet face. A light signal can be output through the light guide arm 8, without the electrical elements required for this necessarily being required in the plug connector. Rather can the light source 15 and an electronic control unit connected to it be arranged on the circuit board 14 in the housing of the electronic device. Alternatively, one or a plurality of light sources can, however, also be arranged inside the plug connector, wherein transmitted light is guided to the sealing ring 5 via the at least one light guide arm 8.

Figure 2:
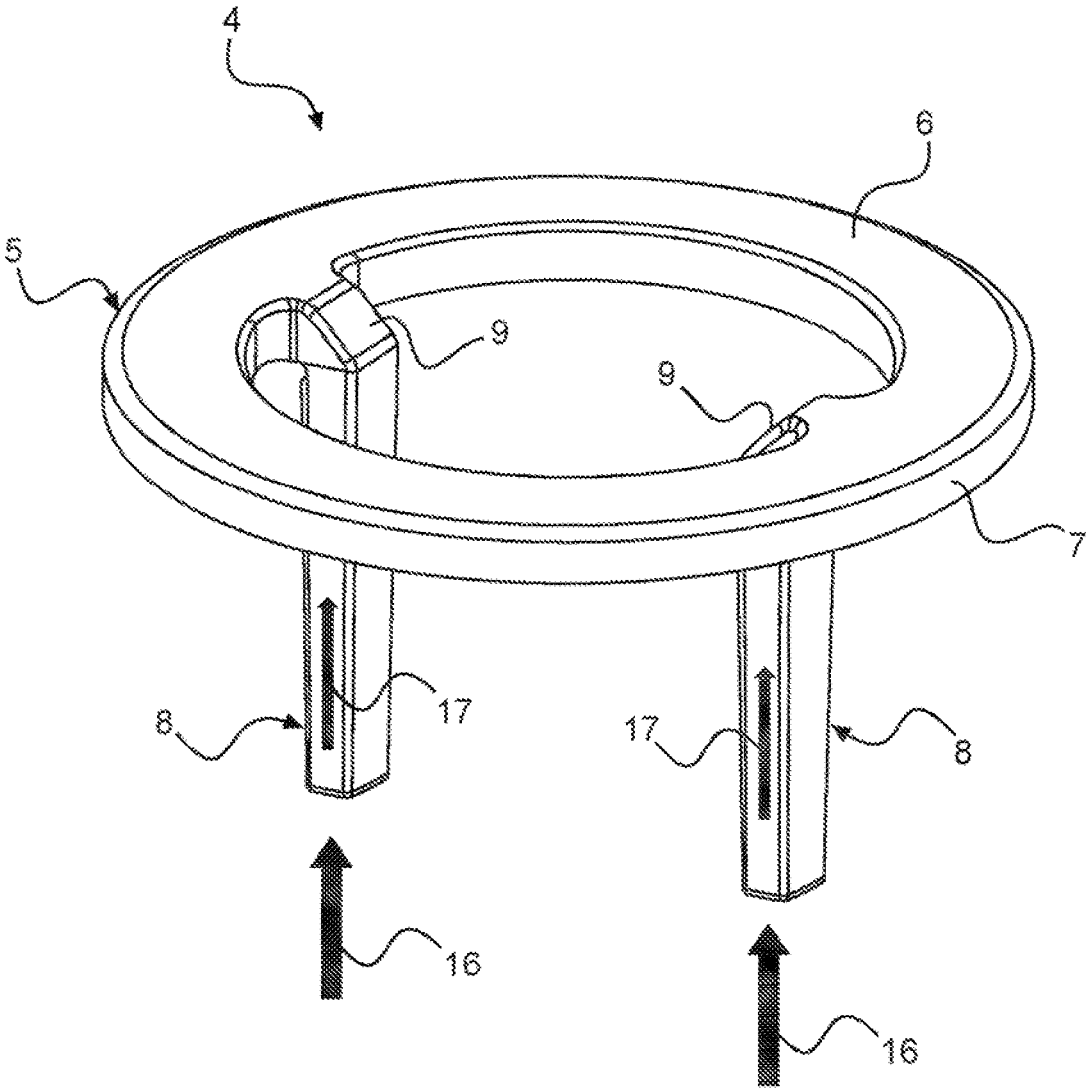
FIG. 2 shows a perspective view of a sealing body of the plug connector from FIG. 1.
Figure 3:
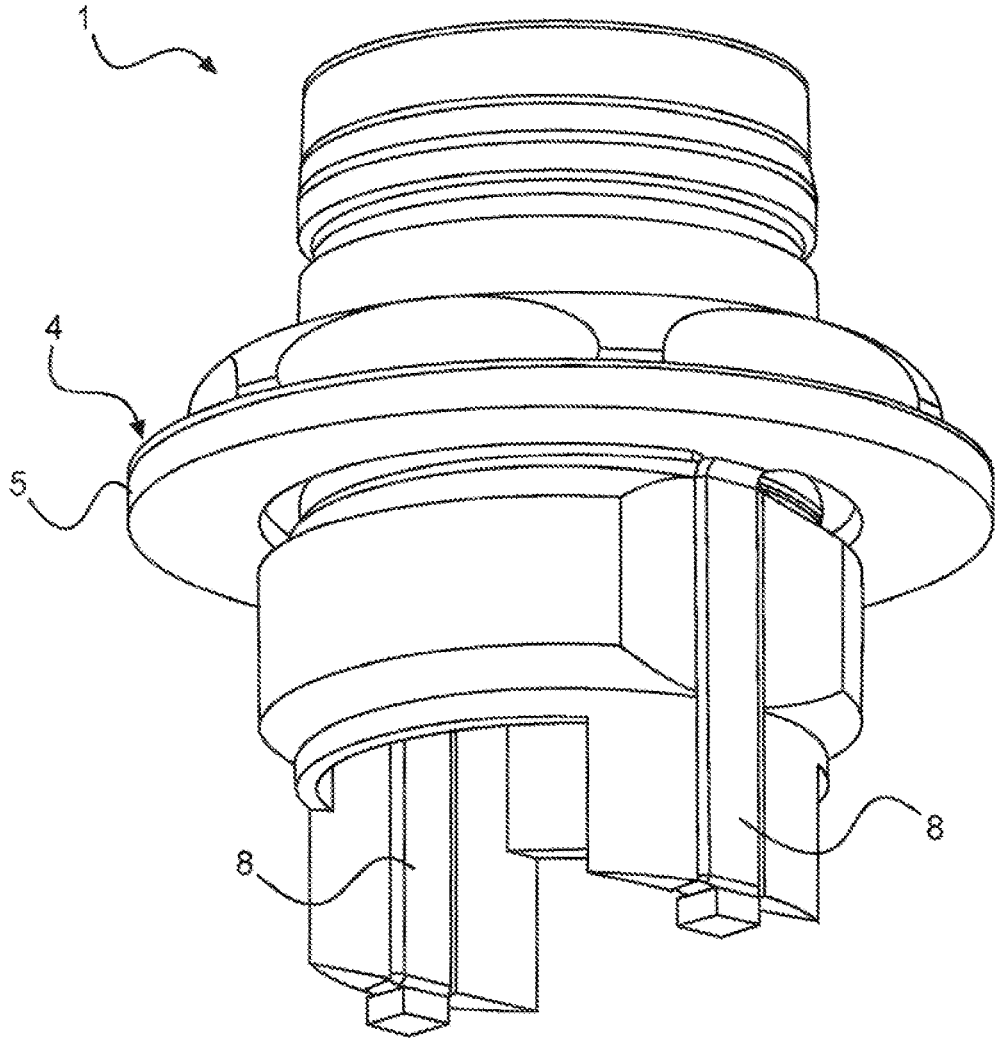
FIG. 3 shows a perspective view of the plug connector of FIG. 1 in a non-installed state.

The arrows 16 in FIG. 2 indicate the direction of propagation of the light that is coupled from the light sources, not illustrated here, by way of the light inlet faces of the light guide arm 8. Light travels in the axial direction in the light guide arms 8, meaning in the direction of the arrow 17 in the longitudinal direction of the plug connector. At an end located opposite to that of the light inlet face, each light guide arm 8 has a deflection face 9 that is oriented at an angle to the axial direction. Light is reflected inside the respective light guide arm 8 at the deflection face 9, and thus coupled into the sealing ring 5. The form of a light guide arm 8 can also be a form modified from that illustrated. In particular, a light guide arm 8 can also be curved or have a plurality of bends, or be oriented at an angle to the axial direction of the plug connector.

The sealing body 5 shown in FIG. 2 can also be employed for components other than the plug connector of FIGS. 1 and 3.

An end face 6 and a jacket face 7 of the sealing ring 5 are roughened so that light is coupled more easily and as uniformly as possible out of the sealing ring 5. Since outward coupling, and the direction of outward radiation, depends on the angle of incidence of the light at the end face 6 or at the jacket face 7, a rough surface leads to a more uniform outward radiation. Because as little outward coupling of the light as possible should take place at the other faces of the sealing body 4, the other faces can, on the other hand, be made smoother than the end face 6 and the jacket face 7.

Because light can be radiated out by way of the end face 6, this should not be completely covered. As shown in FIG. 1, a fastening component 3A that is arranged at the end face of the sealing ring 5 and that serves for fastening at the housing wall 12, has a smaller diameter or a smaller cross-sectional area than the sealing ring 5. The sealing ring 5 can be pressed, in a sealing manner, onto the housing wall 12 by means of an opposing fastening piece 3B, for example a nut.

In the forms of embodiment described above, the plug connector of the invention offers an illuminated indication with good sealing against a housing wall, without additional optical openings being necessary in the housing wall for the illuminated indication.

Even when different aspects or features of the invention are each shown in combination in the figures, it will—unless otherwise stated—be clear to the skilled person that the combinations illustrated and discussed are not the only possibilities. In particular, units or feature complexes from different exemplary embodiments that correspond to one another can be exchanged with one another.

Plug Connector

LIST OF REFERENCE SIGNS

1 Plug connector
2 Electrical contact elements
3A Fastening component
3B Opposing fastening piece
4 Sealing body
5 Sealing ring
6 End face of the sealing ring
7 Jacket face of the sealing ring
8 Light guide arm
9 Deflection face at light guide arm
10 Electronic device
12 Housing wall
14 Circuit board
15 Light source
16 Direction of light propagation from the light source
17 Direction of light propagation within the light guide arm

The invention claimed is:

1. A plug connector with a plurality of electrical contact elements and an elastic sealing body,
wherein
the elastic sealing body comprises a transparent sealing ring that is connected to at least one light guide arm that extends away from the sealing ring, and
wherein each light guide arm comprises a deflection face at which light travelling inside the light guide arm is reflected in the direction of the sealing arm.

2. The plug connector as claimed in claim 1, wherein the at least one light guide arm extends away from the sealing ring in an axial direction.

3. The plug connector as claimed in claim 1, wherein the sealing ring and the at least one light guide arm are formed of the same material.

4. The plug connector as claimed in claim 1, wherein the at least one light guide arm is connected to the sealing ring at an inner face of the sealing ring.

5. The plug connector according to claim 1, wherein the deflection face is oriented at an angle to the light guide arm, that light is reflected to the deflection face through total internal reflection.

6. The plug connector as claimed in claim 1, wherein the deflection face is mirror-finished.

7. The plug connector as claimed in claim 1, wherein
an external jacket face and/or an end face of the sealing ring is roughened so that light is radiated out diffusely,
that an inner face of the sealing ring and a surface of the at least one light guide arm is smooth in order to reduce an outward coupling of light.

8. The plug connector as claimed in claim 1, wherein the sealing ring is widened in the radial direction towards the at least one light guide arm in order to provide a more uniform light propagation in the sealing ring.

9. The plug connector as claimed in claim 1, wherein a cross-section of the at least one light guide arm is enlarged toward the sealing ring in order to achieve a more uniform light distribution in the sealing ring.

10. The plug connector as claimed in claim 1, wherein a radius of the sealing ring is greater than a radius of other components of the plug connector that are located between the sealing ring and a plug end of the plug connector, in order to at least not completely block an outward light radiation at an end face of the sealing ring.

11. The plug connector as claimed in claim 1, wherein to couple in light from multiple light sources, multiple light guide arms are connected to the sealing ring.

12. An electronic device with a housing that comprises at least one opening,
wherein
a plug connector as claimed in claim 1 is arranged in the opening,
at least one light source is present in the housing, and is arranged such that light radiated from the light source is coupled via a light inlet face into the at least one light guide arm of the plug connector.

13. The electronic device as claimed in claim 12, wherein a circuit board on which the at least one light source is located is arranged in the housing, and the light inlet face of the at least one light guide arm is arranged next to the at least one light source and is curved inward.

14. The electronic device as claimed in claim 13, wherein multiple light sources that differ in the spectral bands that they transmit are arranged on the circuit board,
and
that light of the multiple light sources can be guided to the sealing ring via the same light guide arm.

15. A sealing body for at least one plug connector,
with an elastic sealing ring,
wherein
the elastic sealing ring is transparent and is connected to at least one light guide arm that extends away from the sealing ring, and
wherein each light guide arm comprises a deflection face at which light travelling inside the light guide arm is reflected in the direction of the sealing ring.

16. The plug connector as claimed in claim 2, wherein the sealing ring and the at least one light guide arm are formed of the same material.

17. The plug connector as claimed in claim 3, wherein an external jacket face and/or an end face of the sealing ring is roughened so that light is radiated out diffusely,
that an inner face of the sealing ring and a surface of the at least one light guide arm is smooth in order to reduce an outward coupling of light.

18. The plug connector as claimed in claim 3, wherein the sealing ring is widened in the radial direction towards the at least one light guide arm in order to provide a more uniform light propagation in the sealing ring.

19. The plug connector as claimed in claim 3, wherein a cross-section of the at least one light guide arm is enlarged toward the sealing ring in order to achieve a more uniform light distribution in the sealing ring.

20. The plug connector as claimed in claim 1, wherein the sealing ring and the at least one guide are formed in one piece.

* * * * *